US006379103B1

(12) United States Patent
Okugi

(10) Patent No.: US 6,379,103 B1
(45) Date of Patent: Apr. 30, 2002

(54) SUBSTRATE TRANSFER APPARATUS

(75) Inventor: Yasuhiko Okugi, Tokyo (JP)

(73) Assignee: Orc Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/654,566

(22) Filed: Sep. 1, 2000

(30) Foreign Application Priority Data

Dec. 22, 1999 (JP) ..... 11-364858

(51) Int. Cl.[7] ..... H01L 21/68
(52) U.S. Cl. ..... 414/627; 414/752.1; 294/64.3
(58) Field of Search ..... 414/752.1, 627; 294/64.3

(56) References Cited

U.S. PATENT DOCUMENTS 4,009,785 A * 3/1977 Trayes ..... 414/676
6,152,507 A * 11/2000 Pirker ..... 294/64.3

FOREIGN PATENT DOCUMENTS

| | | | |
|---|---|---|---|
| JP | 58141536 | * | 8/1983 |
| JP | 6281725 | * | 4/1987 |
| JP | 383752 | * | 4/1991 |
| JP | 79269 | | 1/1995 |
| JP | 1027838 | * | 1/1998 |

OTHER PUBLICATIONS

NN 740684 IBM Technical Disclosure Bulletin, Jun. 1974.*
Abstract of Japan, Pub. No. 07009269, Pub. Date Jan. 13, 1995.

* cited by examiner

*Primary Examiner*—Steven A. Bratlie
(74) *Attorney, Agent, or Firm*—Liniak, Berenato, Longacre & White

(57) ABSTRACT

The present invention provides a substrate transfer apparatus which can hold the substrate without contacting the surface of the substrate while the substrate is transferred and which does not require the additional prealignment mechanism. The substrate is transferred by a handler. The handler comprises a substrate holding apparatus and a substrate contact apparatus. The substrate holding apparatus includes a noncontact chuck for holding the substrate without contacting the surface of the substrate, and an elevating mechanism for lowering and lifting the noncontact chuck. The substrate contact apparatus includes a contact member to be in contact with the end face of the substrate, a moving mechanism for moving the contact member away from the end face of the substrate when the noncontact chuck is lowered and moving the contact member towards the end face of the substrate when the noncontact chuck is lifted. The handler comprise the appropriate number of the substrate holding apparatus and the appropriate number of the substrate contact apparatus.

6 Claims, 4 Drawing Sheets

SUBSTRATE TRANSFER APPARATUS

FIELD OF THE INVENTION

The present invention relates to a substrate transfer apparatus for transferring a printed substrate with a movable handler, which may be provided in an ultraviolet ray exposing apparatus.

BACKGROUND OF THE INVENTION

In a UV ray exposing apparatus or other exposing apparatus, one of the methods for transferring a substrate carried by a carrying-in roller onto a mounting table and transferring a substrate exposed on the mounting table to a carrying-out roller is holding the substrate by a handler which is provided to move freely while transferring.

Here, in order to hold the substrate, a handler having a plurality of vacuum pads is used, and the sucking force is applied to the surface of the substrate attached to the vacuum pads to vacuum and hold the substrate.

SUMMARY OF THE INVENTION

With the above method of attaching the vacuum pads to the surface of the substrate, because the strong sucking force is applied partially on the surface of the substrate, the following problems arise.

a) In a case that coating agent (ink, resist or others) coated on the substrate is half-dried, the substrate may not be held.

b) In a case that there is the coating agent filled in a through hole penetrating the substrate, the coating agent may be sucked and removed.

c) In a case that the surface of the substrate is uneven that the dust is on the surface of the substrate, it may affect the hold of the substrate.

d) In a case of the thin substrate, the substrate may change its shape and the marks due to vacuum may be remained on the substrate where the vacuum pads are attached.

e) In a case of the thin substrate, the substrate may be bent where the vacuum pads are not attached.

As a method of holding the substrate which does not arise the above problems, there is a method disclosed in the Japanese Patent Laid-open No. 7-9269. This method is that a handler comprising a plurality of vacuum pads having a function of applying tension and a plurality of Bernoulli chucks which are noncontact chucks is used and that the sucking force is applied to the circumference of the surface of the substrate where the vacuum pads are attached and that the circumference of the substrate is vacuumed to be held and that the negative pressure occurs at the top surface of the substrate to which the Bernoulli chucks are faced to hold the top surface of the substrate without contacting the surface of the substrate and that the tension is applied between each of the vacuum pads so that the substrate is not bent.

According to this method, the top surface of the substrate is held by the Bernoulli chucks without contacting the surface of the substrate, so that the above problems a), b), c), d) do not arise. Further, since the tension is applied at the circumference of the substrate by the vacuum pads, the problem e) does not arise.

However, with the method disclosed in the Japanese Patent Laid-open No. 7-9269, since the circumference of the substrate is vacuumed with the vacuum pads, the problems a), b), c), d) still arise.

Further, in order to perform the prealignment for aligning the position of the substrate on the mounting table with the position of the mask pattern, an additional alignment mechanism needs to be provided at either the carrying-in roller or the mounting table. Accordingly, the structure of the apparatus becomes complicated and the process increases.

Therefore, it is an object of the present invention to provide a substrate transfer apparatus which transfers the substrate without contacting the substrate and which does not need the additional prealignment mechanism.

A substrate transfer apparatus of the present invention comprises a handler for transferring a substrate. The handler comprises a substrate holding apparatus comprising a noncontact chuck for holding the substrate without contacting a surface of the substrate, and an elevating mechanism for lifting and lowering the noncontact chuck, and a substrate contact apparatus comprising a contact member to be in contact with an end face of the substrate, a moving mechanism for moving the contact member away from the end face of the substrate as the noncontact chuck is lowered and moving the contact member towards the end face of the substrate as the noncontact chuck is lifted. Here, the handler may comprise a plurality of the substrate holding apparatus and a plurality of the substrate contact apparatus.

Accordingly, the substrate can be held by the noncontact chuck without contacting the surface of the substrate. Moreover, the forward and backward movement of the substrate can be regulated by the contact member.

Further, the contact member may comprise an angled surface for aligning and holding the substrate by being in contact with the end face of the substrate.

Accordingly, the substrate is aligned by the angled surface is which also holds the end face of the substrate. Therefore, since the contact member performs as the aligning member, the additional prealignment mechanism is not required. Moreover, since the contact member also performs as the holding member, even if the operation of the noncontact chuck is terminated, the substrate can stably be held.

Furthermore, the contact member may comprise a supporting member for supporting the substrate by being in contact with the lower surface of the substrate.

Accordingly, the lower surface of the substrate is supported by the supporting member, so that the substrate can be supported without the end face of the substrate to be pushed. Moreover, even if the operation of the noncontact chuck is terminated, the substrate can stably be held.

Further, the moving mechanism comprises a guide for supporting the contact member to be moved in a horizontal direction, a spring for pushing the contact member towards the end face of the substrate, a ball provided in the contact member so as to be rotated, and a bracket to be lowered and lifted connected with the lowering and lifting of the noncontact chuck, provided with a tapered surface to be in contact with the ball to move the contact member.

With this structure, the bracket is lowered as the noncontact chuck is lowered. Then, the ball rotates at the tapered surface, and the contact member is moved along the guide away from the end face of the substrate due to the force of the spring, which means open. Next, the bracket is lifted as the noncontact chuck is lifted. Then, the ball rotates at the tapered surface, and the contact member is moved along the guide towards the end face of the substrate due to the force of the spring, which means closed. Accordingly, the lowering and lifting of the noncontact chuck can be connected to the opening and closing of the contact member with the simple structure.

Furthermore, the substrate transfer apparatus may further comprise a first carrying roller for transferring the substrate, a mounting table for mounting the substrate transferred by the first carrying roller, and a second carrying roller for transferring the substrate after the substrate is exposed on the mounting table. Here, the first carrying roller and the mounting table comprise an air nozzle for blowing compressed air towards the lower surface of the substrate when the noncontact chuck is lowered.

With this structure, when the noncontact chuck is lowered to hold the substrate, the air nozzle blows the compressed air to the lower surface of the substrate. Accordingly, even if the coating agent is half-dried and the viscosity of the surface of the substrate is high, the substrate can easily be removed from the carrying roller. Moreover, even if the substrate is adhered to the mounting table, the substrate can easily be removed from the mounting table.

DESCRIPTION OF THE PREFERRED EMBODIMENTS

1. Structure of the Substrate Transfer Apparatus

Figure 1A:
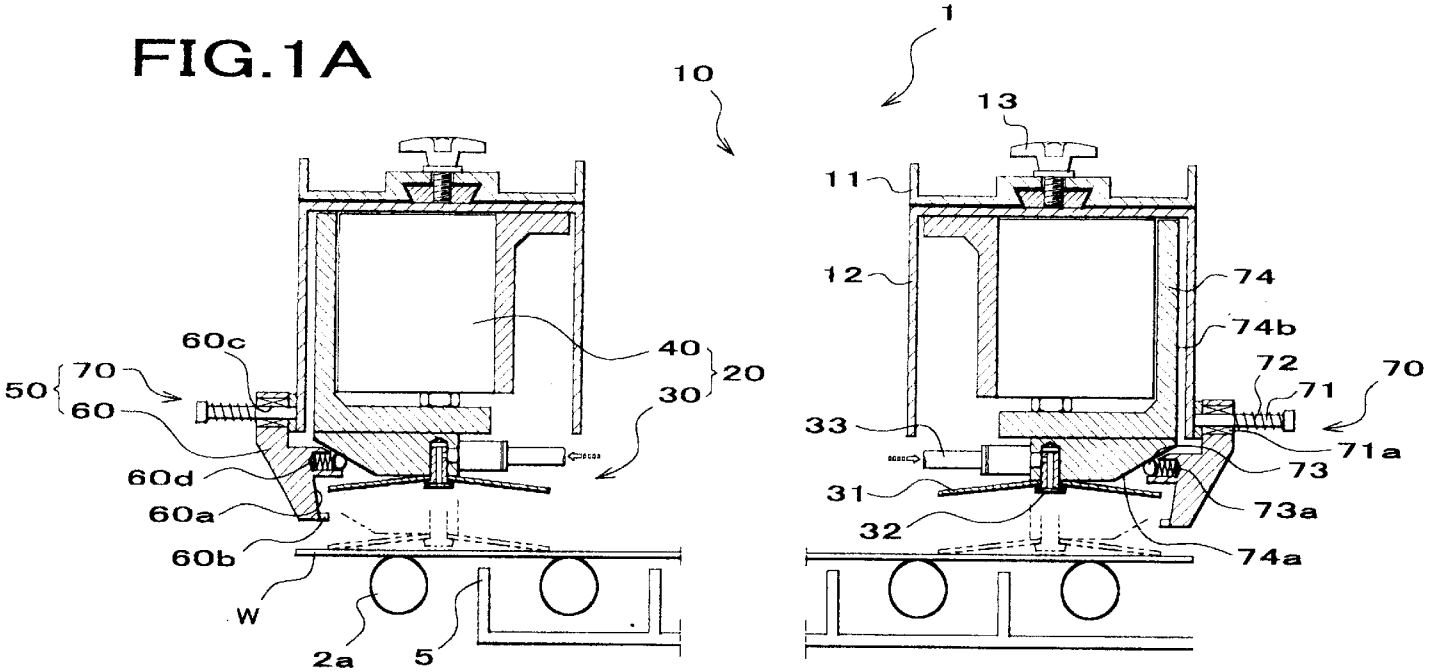
FIG. 1A is a cross sectional view showing a substrate transfer apparatus according to one embodiment of the present invention.

Referring to FIGS. 1A, 1B, 2, 3A, 3B, 4, the structure of the substrate transfer apparatus will be described. FIG. 1A shows a substrate transfer apparatus 1 of one embodiment of the present invention. In FIG. 1A, the middle portion of the apparatus 1 is omitted and only the right and left portions thereof are shown. In the substrate transfer apparatus 1 shown in FIGS. 3A, 3B, only the left portion of the apparatus 1 is shown.

The substrate transfer apparatus 1 is an apparatus for transferring a substrate W by a handler 10 provided to be moved freely.

As shown in FIG. 1A, the handler 10 comprises a plurality of substrate holding apparatus 20 each having a noncontact chuck (Bernoulli chuck 30) and an elevating mechanism (air cylinder 40), and a plurality of substrate contact apparatus 50 each having a contact member 60 and a moving mechanism 70.

The appropriate number of the substrate holding apparatus 20 is the number suitable for holding the substrate W. The appropriate number of the substrate contact apparatus 50 is the number suitable for regulating the forward and backward movement of the substrate W.

Figure 2:
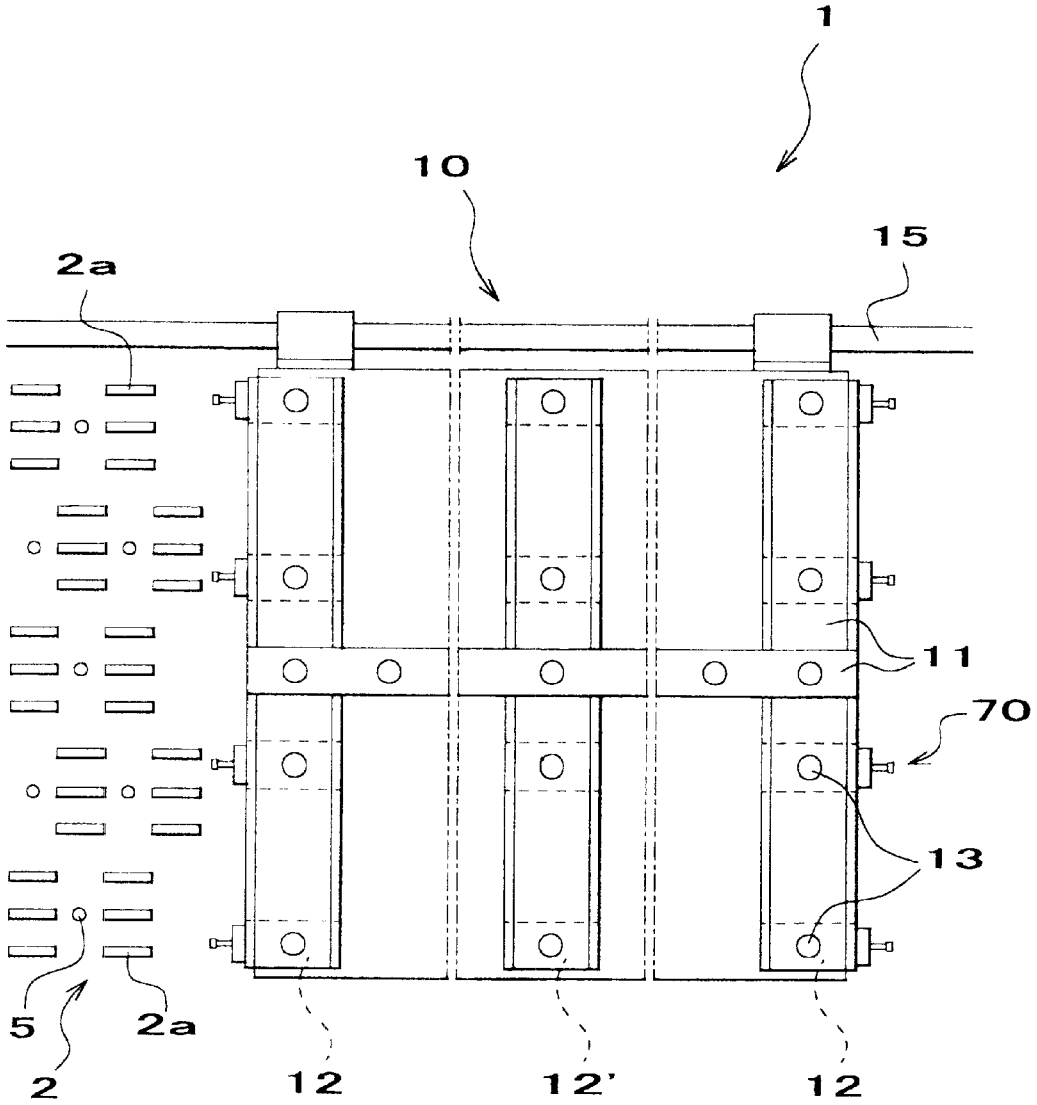
FIG. 2 is a plan view showing the substrate transfer apparatus.

The handler 10, as shown in FIG. 2, comprises a plurality of heads 12 having the substrate holding apparatus 20 and the substrate contact apparatus 50, which are attached to a frame 11 with bolts 13. Further, the handler 10 comprises a plurality of heads 12' having the substrate holding apparatus 20 only, which are attached to the frame 11 with the bolts 13 if required.

In particular, four heads 12 are attached at the left portion of the apparatus 1, four heads 12' at the middle portion thereof, and four heads 12 at the right portion thereof. Preferably, the head 12 is attached to the apparatus 1 so that the rim of a flange 31 is placed at the position few millimeters inside the edge of the substrate W in order to prevent the substrate W from bending (see FIG. 1A). By varying the position of the heads 12, 12', the substrate W of any size and shape can suitably be held.

The handler, as shown in FIG. 2, can freely be moved in the transferring direction of the substrate W with a general moving unit 15 such as an LM guide, a cylinder, a ball screw or others.

Figure 1B:
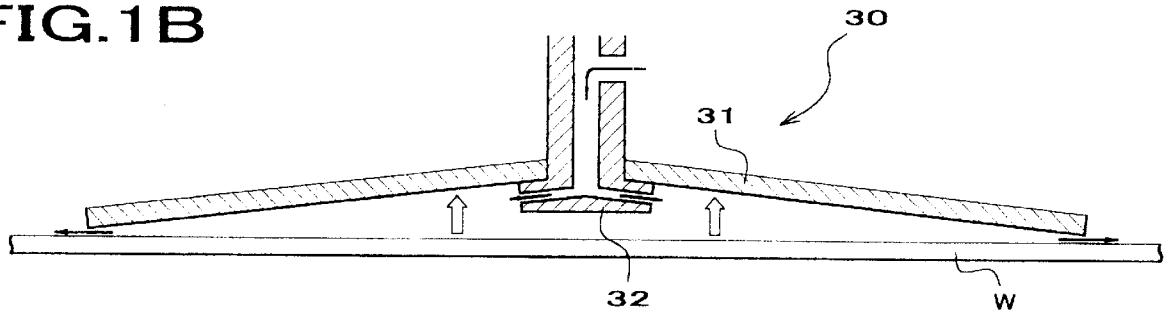
FIG. 1B is a cross sectional view showing the relationship between a substrate and a Bernoulli chuck of the substrate transfer apparatus.

As shown in FIGS. 1A, 1B, the noncontact chuck constituting the substrate holding apparatus 20 is to hold the substrate W without contacting the surface of the substrate W. It is provided to oppose the surface of the substrate W and holds the substrate W without contacting the surface of the substrate W. Fox example, the noncontact chuck can be a Bernoulli chuck 30.

The Bernoulli chuck 30, as shown in FIG. 1A, comprises a nozzle 32 at the middle of a facing-down funnel-shaped flange 31. The nozzle 32 blows air (compressed air or nitrogen gas) along the surface of the flange 31. The air is provided from an air supply device (not shown) through a hose 33. It should be noted that the flange 31 is not limited to the funnel-shaped one. It can be a disc-shaped one.

The Bernoulli chuck 30, as shown in FIG. 1B, blows the air along the angled surface of the flange 31. Then, the air exits from the gap between the flange 31 and the surface of the substrate W (as shown by a fine arrow), and the flange 31 draws the substrate W (as shown by a bold arrow) by the negative pressure generated in the air blowing direction. Therefore, the Bernoulli chuck 30 can hold the substrate W without contacting the surface of the substrate W.

For example, in the case of the flange 31 having the diameter of ø75 and the pressure of 0.3 MPa, the substrate W of 1 N can be held. The chuck 30 can hold any size of the substrate 30 by varying the air pressure (flow rate).

The elevating mechanism constituting the substrate holding apparatus 20, as shown in FIG. 1A, is to lift the Bernoulli chuck 30. For example, the elevating mechanism may be an air cylinder 40.

Figure 3A:
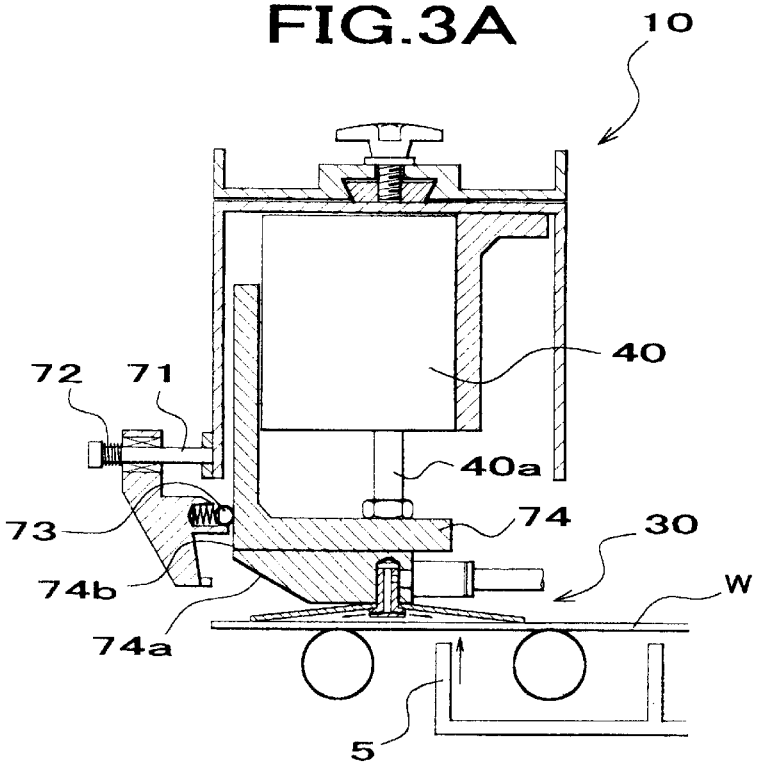
FIG. 3A is a cross sectional view showing the operation of the substrate transfer apparatus.
Figure 3B:
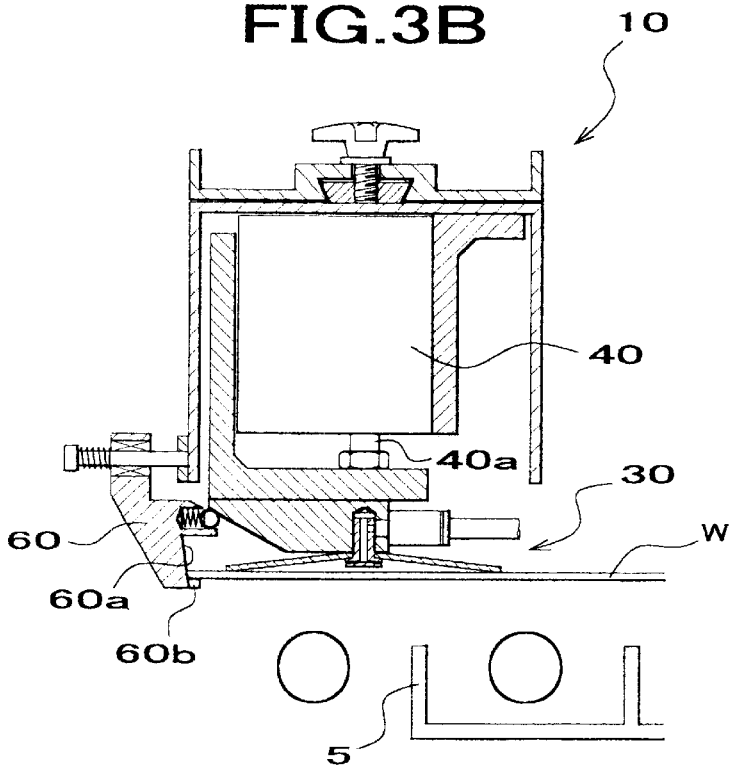
FIG. 3B is a cross sectional view showing the process of aligning the substrate.

The air cylinder 40, as shown in FIGS. 3A, 3B, is provided to the head 12 downward and comprises a rod 40*a* elongating downward. Further, the Bernoulli chuck 30 is placed at the lower end of the rod 40*a* over a bracket 74.

The contact member 60 constituting the substrate contact apparatus 50, as shown in FIG. 1A, is to contact with the end face of the substrate W. The contact member 60 is arranged to oppose the end face of the substrate W so as to be in contact with at least the front and back end faces of the substrate W in the transferring direction. The member 60 regulates the forward and backward movement of the substrate W without contacting the surface of the substrate W.

In particular, the contact member 60 is positioned above the substrate W (see FIG. 1A) before the substrate W is held, and while the substrate W is held, the member 60 is positioned above the end face of the substrate W (see FIG. 3A). Further, while the substrate W is transferred, the member 60 is positioned to oppose the end face of the substrate W (see FIG. 3B).

The contact member 60, as shown in FIG. 1A, has an angled surface 60*a* which becomes narrower to the lower end and which aligns and holds the substrate W by contacting the surface of the substrate W.

In order to regulate the forward and backward movement of the substrate W, the contact member 60 requires only the vertical surface; however, as shown in FIG. 3B, since the substrate W is aligned by the angled surface 60*a* pushing the end face of the substrate W, the contact member 60 performs as an aligning member. Accordingly, the additional prealignment mechanism is not required on a carrying-in roller 2 and a mounting table 3 (see FIG. 4).

Further, as shown in FIG. 3B, since the end face of the substrate W is held by the angled surface 60*a*, the contact member 60 also performs as the holding member. Accordingly, even if the operation of the air supply device is stopped due to power failure and the operation of the Bernoulli chuck 30 is stopped, the substrate W can stably be held.

Furthermore, the contact member 60, as shown in FIG. 1A, is a hook-shaped member protruded inward. It includes a supporting member 60*b* for supporting the substrate W by contacting the lower surface of the substrate W.

As shown in FIG. 3B, the lower surface of the end face of the substrate W is held by the supporting member 60*b*. Accordingly, the substrate W can be held without pushing the end faces of the substrate W. Moreover, even if the operation of the air supply device is stopped due to power failure and the operation of the Bernoulli chuck 30 is stopped, the substrate W can stably be held.

The contact member 60, as shown in FIG. 1A, comprises a guide hole 60*c* which is a through hole for a guide 71 to be inserted, and a ball hole 60*d* for containing a ball 73 to be rotated.

The moving mechanism 70 constituting the substrate contact apparatus 50 is to move the contact member 60. In particular, it moves the contact member 60 in the direction opposite to the end face of the substrate W when the Bernoulli chuck 30 before holding the substrate W is lowered. On the other hand, it moves the contact member 60 in the direction towards the end face of the substrate W when the Bernoulli chuck 30 after holding the substrate W is lifted.

The moving mechanism 70, as shown in FIG. 1A, comprises a guide 71, a spring 72, a ball 73 and a bracket 74.

The guide 71 is a rod having a head protruded outward from the outer side surface of the head 12. The guide 71 is inserted into the guide hole 60*c* with a straight bearing 71*a* which is a slidable supplement unit so that the contact member 60 is supported to be moved horizontally.

The spring 72 is placed between the outer side surface of the contact member 60 and the head of the guide 71 to push the contact member 60 toward the end face of the substrate W.

The ball 73 is contained rotatively in the ball hole 60*d* and pushed by a spring 73*a* placed in the same hole 60*d* from the back thereof towards a tapered surface 74*a*. Then, the ball 73 rotates owing to the tapered surface 74*a* and the vertical surface 74*b*.

The bracket 74 is an L-shaped member provided under the end of the rod 40*a*. The bracket 74 comprises the tapered surface 74*a* tilted in the direction narrower to the lower end, and the vertical surface 74*b* above the surface 74*a*. There is the Bernoulli chuck under the bracket 74. The bracket 74 is moved up and down as the Bernoulli chuck 30 is moved up and down, respectively. Then, the tapered surface 74*a* is brought in contact with the ball 73 to move the contact member 60.

With such a moving mechanism 70, the lowering and lifting of the Bernoulli chuck 30 can be communicated with the opening and closing of the contact member 60 by the simple structure, respectively.

Next, the substrate transferring apparatus 1 is utilized to an ultraviolet ray exposing apparatus.

Figure 4:
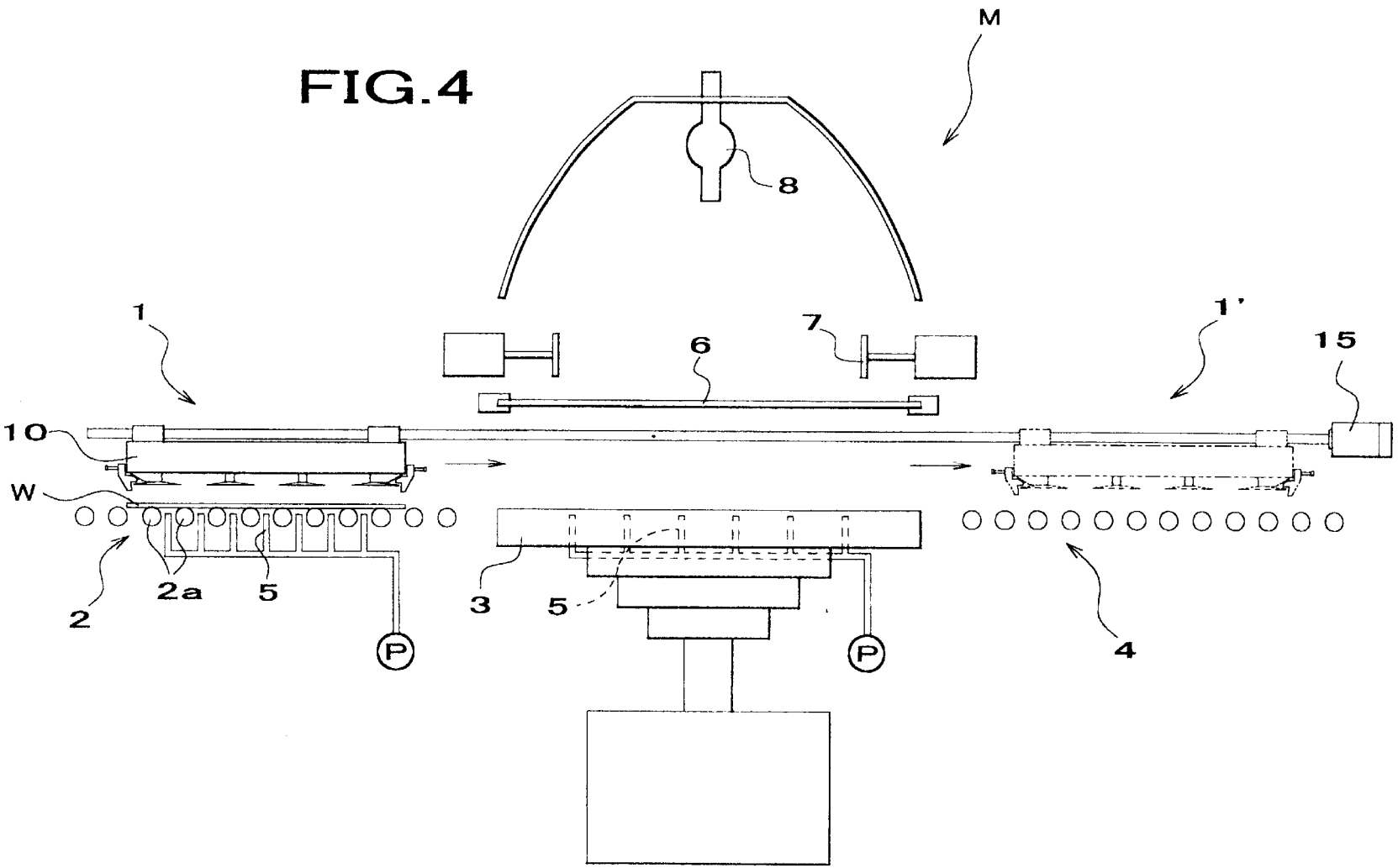
FIG. 4 is a sectional view showing the substrate transfer apparatus utilized in a UV exposing apparatus.

The UV ray exposing apparatus M, as shown in FIG. 4, comprises the carrying-in roller 2, the mounting table 3, and the carrying-out roller 4. The substrate transferring apparatus 1 is moved between the carrying-in roller 2 and the mounting table 3, and the substrate transferring apparatus 1' is moved between the mounting table 3 and the carrying-out roller 4, so that the substrate W is transferred. Here, the substrate transferring apparatus 1' has the same configuration as the substrate transferring apparatus 1.

The carrying-in roller 2, as shown in FIG. 1A to FIG. 4, comprises a plurality of air nozzles 5 for blowing the compressed air between each of a plurality of roller members 2*a*. The mounting table 3, as shown in FIG. 4, comprises air nozzles 5 for blowing the compressed air from plural holes. on the other hand, the carrying-out roller 4 does not comprise any air nozzle.

The air nozzle 5 may be provided to both of the carrying-in roller 2 and the mounting table 3 as shown in FIG. 4 or to only the carrying-in roller 2 or to only the mounting table 3.

The air nozzle 5, as shown in FIG. 3A and FIG. 4, blows the compressed air supplied from a pump P towards the lower surface of the substrate W at the same time as the Bernoulli chuck 30 is lowered.

With such an air nozzle 5, the substrate W can be removed from the carrying-in roller 2 even though the coating agent is half-dried and the viscosity of the surface of the substrate W is high. Further, even if the substrate W is adhered to the mounting table 3, the substrate W can easily be removed from the mounting table 3.

As shown in FIG. 4, the UV exposing apparatus comprises an upper frame 6 provided with a mask pattern, a CCD camera 7 for taking the image of the aliment mark, an alignment mechanism (not shown) for correcting the position of the substrate W, a vacuum suction mechanism (not shown) for bringing the substrate W tightly in contact with the mask pattern, and a UV lamp 8 for exposure.

2. Operation of the Substrate Transferring Apparatus

The substrate transferring apparatus 1 has the following operation as shown in FIGS. 1A to 4.

1) Initial Condition (see FIG. 4 and FIG. 1A)

The substrate W is transferred into the carrying-in roller 2 through the carrying passage such as a conveyor provided at the outside of the UV ray exposing apparatus M, which is shown in FIG. 4 and FIG. 1A.

2) Hold of the Substrate (see FIG. 3A)

The air (compressed air or nitrogen gas) is supplied to the nozzle 32 of the Bernoulli chuck 32 from the air supply apparatus (not shown) and blown off along the surface of the flange 31.

Here, when the rod 40*a* of the air cylinder 40 is elongated, the bracket 74 is lowered as the Bernoulli chuck 30 is lowered. Then, the ball 73 rotates owing to the vertical surface 74*b* and the tapered surface 74*a* formed at the bracket 74. The contact member 60 is moved away from the end face of the substrate W along the guide 71 due to the force of the spring 72 and then the contact member 60 opens.

At the same time, the substrate W is held at the Bernoulli chuck 30 without contacting the surface of the substrate W, which is shown in FIG. 3A.

Here, it should be noted that the substrate W can easily be removed from the carrying-in roller 2 by blowing the compressed air through the air nozzles 5.

3) Alignment of Substrate (see FIG. 3B)

When the rod 40*a* of the air cylinder 40 is shortened, the bracket 74 is lifted as the Bernoulli chuck 30 is lifted. Then, the ball 73 rotates owing to the vertical surface 74*b* and the tapered surface 74*a* formed at the bracket 74. The contact member 60 is moved towards the end face of the substrate W along the guide 71 due to the force of the spring 72 and then the contact member 60 is closed.

At the same time, the substrate W is aligned by the angled surface 60*a* of the contact member 60 in contact with the end face of the substrate W and held stably by the supporting member 60*b*, which is shown in FIG. 3B. Since while the substrate W is being held, the substrate W is also aligned, the additional prealignment mechanism is not required.

To avoid the transform of the substrate W due to the force of the contact members 60, the lifting distance of the Bernoulli chuck 30 or the moving distance of the contact members 60 when closed needs to be controlled appropriately.

4) Transfer of the Substrate (see FIG. 4)

The substrate W is moved with the handler 10 while the forward and backward movement is regulated by the contact members 60 and transferred to the mounting table 3 from the carrying-in roller 2.

Here, the rod 40*a* of the air cylinder 40 is elongated again and the contact members 60 are open. Then, the air to the Bernoulli chuck 30 is terminated, and the substrate W is released to be mounted on the mounting table 3.

5) Exposure of the Substrate (see FIG. 4)

When the mounting table 3 with the substrate W on is lifted, the substrate W is brought closer to the upper frame 6 provided with the mask pattern, and the images of the alignment marks of the substrate W and the mask pattern are taken with the CCD camera 7. If they are not aligned, the substrate is aligned again by the alignment mechanism (not shown). After they are aligned, the substrate W is exposed with the UV lamp 8. Thereafter, the mounting table 3 is lowered.

6) Transfer of the Substrate (see FIG. 4)

As similar to the steps described in 2), 3), 4), while the substrate W is held and the forward and backward movement is controlled by the substrate transferring apparatus 1', it is transferred onto the carrying-out roller 4 from the mounting table 3.

Here, when the substrate W is held, the substrate W can easily be removed from the mounting table 3 by blowing the compressed air from the air nozzles 5.

Therefore, as described above, according to the above embodiment of the present invention, the following effects can be achieved.

1) Because of the noncontact chuck, the substrate can be held without contacting the surface of the substrate W.

Accordingly, a) even if the coating agent (ink, resist or others) coated on the substrate is half-dried, the substrate can be held.

b) Even if the coating agent filled in a through hole penetrating the substrate, the coating agent is never be sucked and removed.

c) Even if the surface of the substrate is uneven or the dust is on the surface of the substrate, it does not affect the holding of the substrate.

d) Even if the substrate is thin, the substrate never changes the shape and the marks due to vacuum are never remained on the substrate where the vacuum pads are attached.

e) Even if the substrate is thin, the substrate is never bent.

Further, because of the contact member, the forward and backward movement of the substrate can be regulated. Accordingly, the substrate can be transferred without contacting the surface of the substrate.

2) Because of the angled surface, the additional prealignment mechanism is not required. Further, even if the operation of the noncontact chuck is terminated, the substrate can be held stably.

3) Because of the supporting member, the substrate can be supported without the end faces of the substrate to be pushed. Further, even if the operation of the noncontact chuck is terminated, the substrate can be supported stably.

4) Because of the moving mechanism, the lowering and lifting of the Bernoulli chuck can be worked together with the opening and closing of the contact members with the simple structure.

5) Because of the air nozzles, the substrate can easily be removed from the carrying-in roller or the mounting table.

What is claimed is:

1. A substrate transfer apparatus comprising a handler for transferring a substrate:

said handler comprising:

a substrate holding apparatus comprising a noncontact chuck for holding said substrate without contacting an upper surface of said substrate, and an elevating mechanism for lifting and lowering said noncontact chuck; and a substrate contact apparatus comprising a contact member being in contact with an end face of said substrate, a moving mechanism for moving said contact member away from the end face of said substrate as said noncontact chuck is being lowered and moving said contact member towards the end face of said substrate as said noncontact chuck is being lifted, wherein said contact member comprises a supporting member for supporting said substrate by being in contact a lower surface of said substrate opposite said upper surface, said supporting member defining a shelf engaging said lower surface to support said substrate without engaging said end face.

2. A substrate transfer apparatus according to claim 1, wherein said handler comprises a plurality of said substrate holding apparatus and a plurality of said substrate contact apparatus.

3. A substrate transfer apparatus according to claim 1, wherein said contact member comprises an angled surface for aligning and holding said substrate by being in contact with the end face of said substrate.

4. A substrate transfer apparatus according to claim 1, wherein said moving mechanism comprising a guide for supporting said contact member to be moved in a horizontal direction;

a spring for pushing said contact member towards the end face of said substrate;

a ball provided in said contact member so as to be rotated; and a bracket to be lowered and lifted connected with the lowering and lifting of said noncontact chuck, provided with a tapered surface to be in contact with said ball to move said contact member.

5. A substrate transfer apparatus according to claim 1 further comprising a first carrying roller for transferring said substrate, a mounting table for mounting said substrate transferred by said first carrying roller, and a second carrying roller for transferring said substrate after said substrate is exposed on said mounting table; and said first carrying roller and said mounting table comprise an air nozzle for blowing compressed air towards the lower surface of said substrate when said noncontact chuck is lowered.

6. The substrate transfer apparatus of claim 1, wherein said contact member moves in a horizontal direction relative to said noncontact chuck.

* * * * *